US008287071B2

(12) United States Patent
Kuki et al.

(10) Patent No.: US 8,287,071 B2
(45) Date of Patent: Oct. 16, 2012

(54) INKJET RECORDING APPARATUS

(75) Inventors: Takakazu Kuki, Tokyo (JP); Hideyuki Kobayashi, Tokyo (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 291 days.

(21) Appl. No.: 12/820,237

(22) Filed: Jun. 22, 2010

(65) Prior Publication Data

US 2010/0328381 A1 Dec. 30, 2010

(30) Foreign Application Priority Data

Jun. 29, 2009 (JP) ..... 2009-153577
Jul. 17, 2009 (JP) ..... 2009-168784
Jun. 9, 2010 (JP) ..... 2010-131792

(51) Int. Cl.
*B41J 29/38* (2006.01)

(52) U.S. Cl. ..... 347/11

(58) Field of Classification Search ..... 347/11
See application file for complete search history.

(56) References Cited

U.S. PATENT DOCUMENTS 6,899,409 B2 * 5/2005 Kusunoki ..... 347/11

FOREIGN PATENT DOCUMENTS

| | | |
|---|---|---|
| EP | 1-004-441 | 5/2000 |
| JP | 95/25011 | 9/1995 |
| JP | 2004-058300 | 2/2004 |
| JP | 2004-58300 A | 2/2004 |
| JP | 4161631 B2 | 10/2008 |

* cited by examiner

*Primary Examiner* — Julian Huffman
(74) *Attorney, Agent, or Firm* — Lucas & Mercanti, LLP

(57) ABSTRACT

An inkjet recording apparatus including a recording head having a nozzle, a pressure chamber, and a pressure generation section; and a drive signal generator which generates a drive signal for applying at least one drive pulse, wherein the apparatus ejects the ink droplet from the nozzle by applying the drive signal to activate the pressure generation section, wherein the drive signal generator generates the drive signal within one pixel period in chronological order including a first expansion pulse to expand the volume of the pressure chamber, a contraction pulse, and a second expansion pulse, and wherein a contraction pulse width is 0.1 AL through 0.5 AL, where AL represents a half of an acoustic resonance period of the pressure chamber, and |Von|/|Voff| is 1.3 through 10, where Von and Voff respectively represent drive voltages of the first expansion pulse and the contraction pulse.

9 Claims, 16 Drawing Sheets

INKJET RECORDING APPARATUS

TECHNICAL FIELD

This invention relates to inkjet recording apparatus for ejecting an ink droplet (liquid droplet) from a nozzle.

BACKGROUND

In an inkjet apparatus, in order to realize a high quality recording, the ink dot diameter needs to be made small. As a method of reducing the recording dot diameter, it is conventionally known to utilize a "pull-push driving" system where a pressure chamber communicating to a nozzle opening is contracted after temporarily expanded. According to this system, the mass of each ink droplet can be reduced, and the recording dot diameter can be minified.

As the recording heads utilizing piezoelectric elements as pressure generation devices, there are a system of applying a vibration plate (for example, a laminated piezoelectric layer method and a deflection mode method), and a shear deformation system where a partition wall of a pressure chamber is shear deformed without using the vibration plate.

In the laminated piezoelectric layer method which changes the volume of the pressure chamber via the vibration plate, since the piezoelectric element is disposed outside the pressure chamber, the shape and size of the piezoelectric element is not so much restricted, and it is possible to generate high pressure by using a powerful piezoelectric element, thus this method is good at ejection capability and ejection control of the ink droplet. However, the structure of such an inkjet head becomes complicated, manufacturing of a large capacity head is difficult, and a head having about 100 channels may be a limit.

In contrast, since the head of shear deformation mode system has a simple structure where grooves are formed to be pressure chambers in a piezoelectric element, a large capacity head having several hundred channels is possible to be manufactured. However, especially in the cases where drive signals of a rectangular pressure wave are applied to the recording head of shear mode system, ejection of a minute droplet is difficult due to the influence of pressure wave vibration in the pressure chamber.

In Examined Japanese Patent Application Publication No. 4161631 (Patent Document 1) described is a method of forming a minute droplet by utilizing a head of the shear mode system, applying voltages to deform the pressure chamber in order of a first expansion, contraction and a second expansion, and by controlling a ratio of the voltages and a width of the contraction pulse. Wherein, a pulse width of the first expansion pulse is referred as t1, a pulse width of the contraction pulse as t2, and a pulse width of the second expansion pulse is referred as t3.

However in a case where the pressure chamber is driven with a contraction pulse width t2 as described in the above mentioned Patent Document 1, a pressure wave vibration which is generated at the edge portion of the drive pulse cannot be effectively canceled and residual vibration remains largely. Therefore, to execute high frequency drive in this state is difficult. Further, Patent Document 1 describes an example of applying a second contraction pulse is applied to cancel the residual vibration. However, by applying the second contraction pulse, the total waveform of the pulses becomes long, which leads to decrease of the drive frequency. Further, even in the case where t2+t3=AL (AL: half of the acoustic resonance period of the pressure chamber) is satisfied without applying the second contraction pulse, as described in Patent Document 1, the residual vibration cannot be sufficiently canceled, which leads to greatly decreasing the drive stability. In order to obtain sufficient drive stability, it is necessary to wait for a sufficient time period until the residual vibration decays before the next drive, which results in the decrease of drive frequency.

Further, according to Patent Document 1, the droplet volume may be reduced to be 10 pl, however further reduction of the droplet volume is required in market.

SUMMARY

Accordingly, an objective of the present invention is to provide a drive method of inkjet head which is capable of stably ejecting a further minified droplet with a high drive frequency.

Embodiments of inkjet recording apparatus reflecting an aspect of the present invention are:

(1) An inkjet recording apparatus including: a recording head having a nozzle to eject an ink droplet, a pressure chamber connected to the nozzle, and a pressure generation section to vary a volume of the pressure chamber; and a drive signal generator which generates a drive signal for applying at least one drive pulse to eject the ink droplet, wherein the inkjet recording apparatus is configured to eject the ink droplet from the nozzle by applying the drive signal to activate the pressure generation section, wherein the drive signal generator is configured to generate the drive signal within one pixel period in chronological order including a first expansion pulse to expand the volume of the pressure chamber, a contraction pulse to contract the volume of the pressure chamber, and a second expansion pulse to expand the volume of the pressure chamber again, and wherein a contraction pulse width is not less than 0.1 AL and not more than 0.5 AL, where AL represents a half of an acoustic resonance period of the pressure chamber, and |Von|/|Voff| is not less than 1.3 and not more than 10, where Von represents a drive voltage of the first expansion pulse, and Voff represents a drive voltage of the contraction pulse.

(2) The inkjet recording apparatus described in (1), wherein a pulse width of the second expansion pulse is not less than 0.2 AL and not more than 0.6 AL.

(3) The inkjet recording apparatus described in (1) or (2), wherein a sum of pulse widths of the contraction pulse and the second expansion pulse is not less than 0.3 AL and not more than 0.9 AL.

(4) The inkjet recording apparatus described in any one of (1) to (3), wherein pulse width of the first expansion pulse is 1 AL.

(5) The inkjet recording apparatus described in any one of (1) to (4), wherein a pulse width of the contraction pulse is less than a pulse width of the second expansion pulse.

(6) The inkjet recording apparatus described in any one of (1) to (5), wherein the apparatus varies a pulse width of the contraction pulse within a range of 0.1 AL through 0.5 AL to control a volume of the ink droplet.

(7) The inkjet recording apparatus described in any one of (1) to (6), wherein the drive signal generator is configured to generate the drive signal for applying a plurality of drive pulses within one pixel period, in such a manner that a plurality of ink droplets each ejected by each of the plurality of drive pulses are united before or after landing on recording medium to form a single pixel.

(8) The inkjet recording apparatus described in (7), wherein the plurality of drive pulses include plural types of drive pulses respectively having contraction pulse widths different with each other within a range from 0.1 AL through 0.5

AL, and the respective plural types of drive pulses cause to eject plural types of ink droplets having different volumes with each other.

(9) The inkjet recording apparatus described in any one of (1) to (8), wherein a drive voltage of the second expansion pulse is equal to a drive voltage Von of the first expansion pulse.

DESCRIPTION OF THE PREFERRED EMBODIMENTS

The present invention will be described below in detail however the present invention is not limited by the description below.

Figure 1:
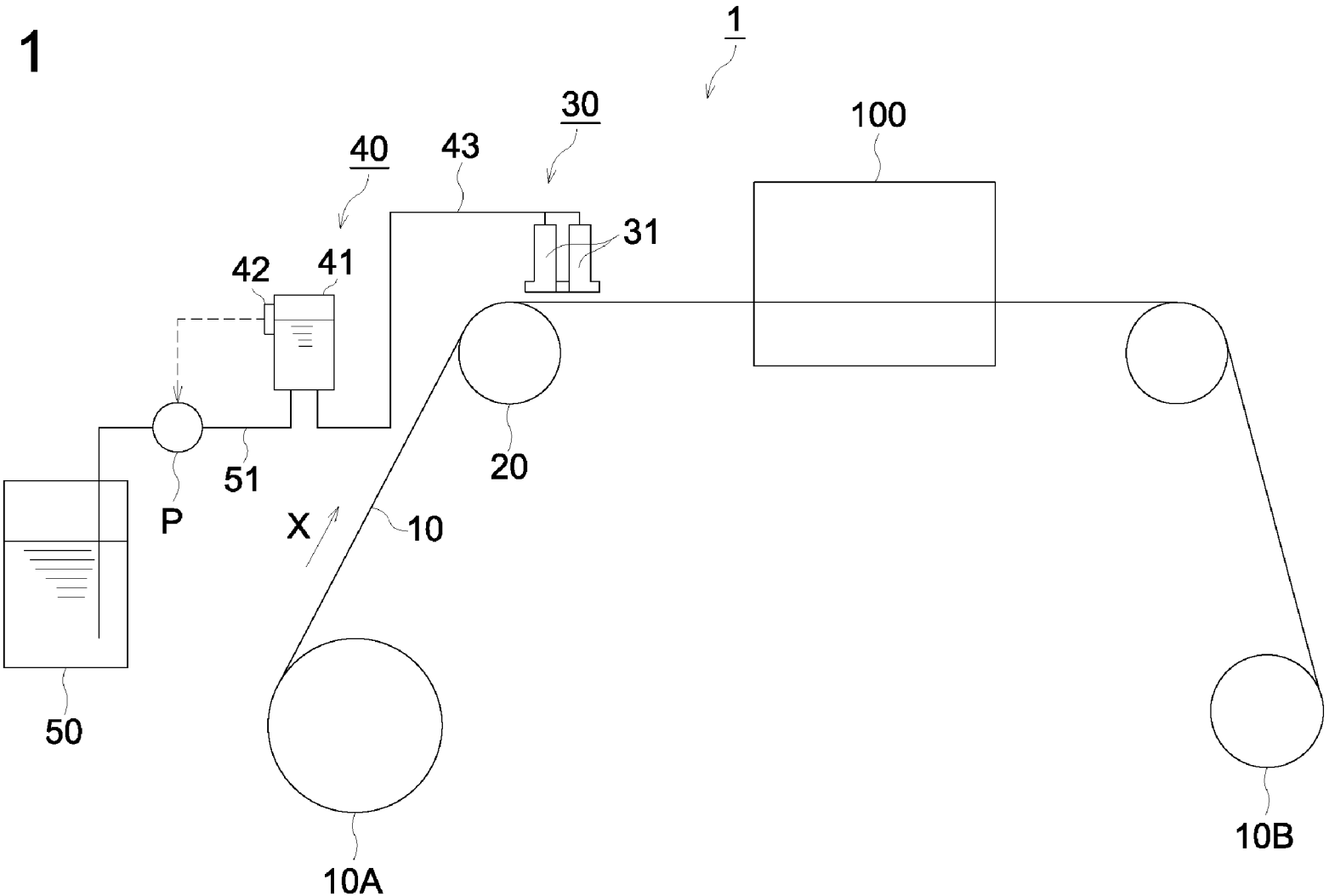
FIG. 1 is a schematic diagram showing a configuration of a line type inkjet recording apparatus.

FIG. 1 is a schematic drawing showing the configuration of the line type inkjet recording apparatus I.

As shown in FIG. 1, elongated rolled recording medium 10 is pulled-out and conveyed from rolling-out roll 10A in a direction of arrow X by unillustrated drive means.

Elongated rolled recording medium 10 is conveyed while being trained and supported by back roll 20. From inkjet head unit 30, ink is ejected toward recording medium 10, to pedal in image formation based on image data. Inkjet head unit 30 is provided with a plurality of recording heads 31 corresponding to an ejection width in the width direction of the recording medium.

Figure 2:
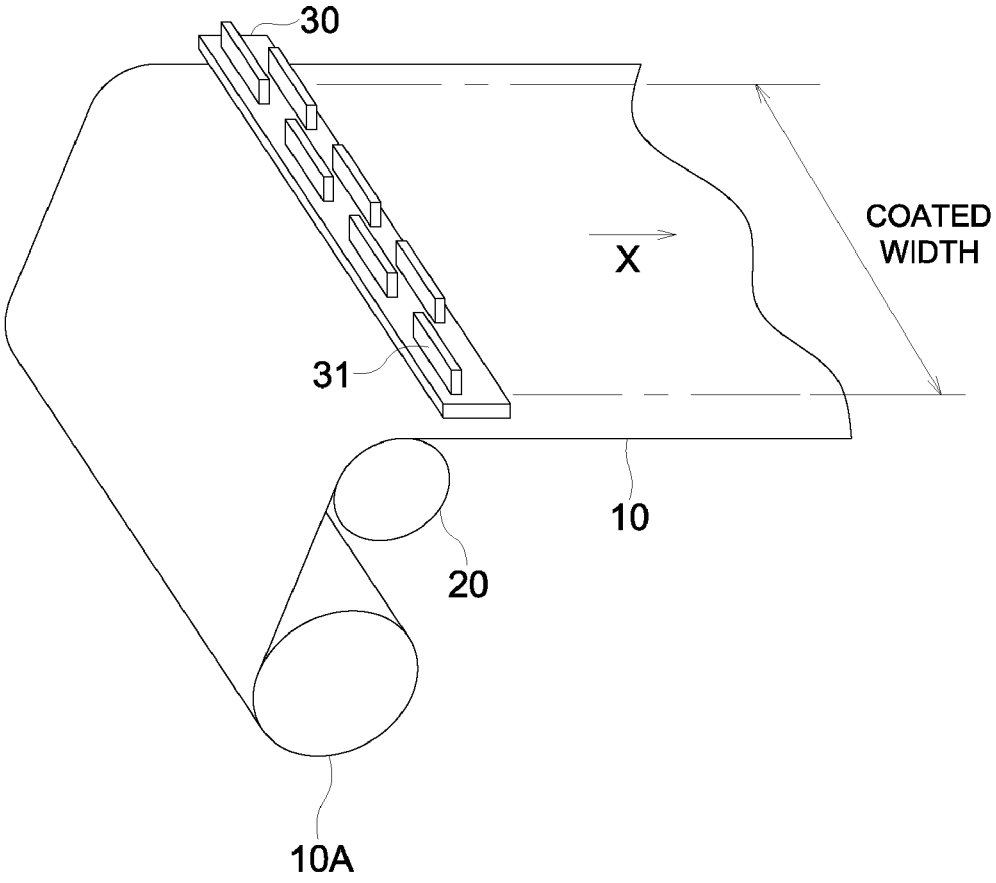
FIG. 2 is a schematic diagram showing a configuration of an inkjet head unit.

FIG. 2 shows an example for arrangement of inkjet head 31 in inkjet head unit 30. In this example, all inkjet head 31 are arranged in positions of a same height with respect to intermediate tank 40 temporarily reserving the ink. Since an ejection width of each inkjet head is less than the outer shape width size of the recording head, a plurality of inkjet heads are arranged in zigzag with respect to the conveying direction of the recording medium. In the example shown in FIG. 2, the plurality of inkjet heads, each corresponding to the ejection width in the width direction of recording head, are arranged in two rows zigzag arrangement.

Figure 3:
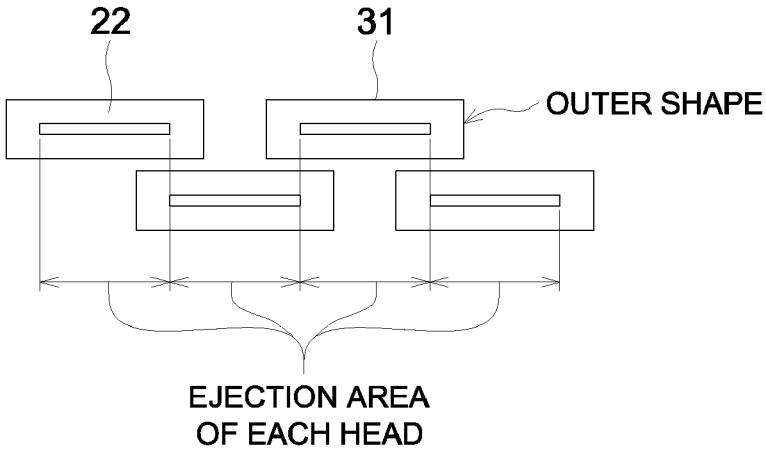
FIG. 3 is diagram showing an example of arrangement for inkjet head in the inkjet head unit.

FIG. 3 is a diagram showing a relationship of outer shape, ejection width and a zigzag arrangement of inkjet head 31. Since the number of inkjet heads 31 and the number of rows in zigzag arrangement are properly determined according to the ejection width and the like, the arrangement is not limited to that shown in FIG. 3.

In FIG. 1, the ink is supplied via plural ink tubes 43 to each inkjet head 31 from intermediate tank 40 which adjusts a back-pressure of the ink in inkjet head 31. In the present embodiment, ink tube 43 in FIG. 1 represents a plurality of ink tubes.

Ink supply to intermediate tank 40 is conducted by liquid sending pump P provided between reservoir tank 50 to reserve ink and supply pipe 51.

Recording medium 10 on which an image has been formed is dried at drying section 100 and is rolled on take-up roll 10B.

In a state that inkjet head 31 stands still, image recording is executed while the recording medium is conveyed in the conveyance direction. While the recording medium is being conveyed, drive signals are selected based on image data for each pixel period and ink ejection state changes accordingly.

Each inkjet head 31 is arranged such that the nozzle plane is opposed to a recording surface of recording medium 10, and electrically connected via flexible cable 6 (FIG. 4) to drive signal generator 100 (refer to FIG. 5*a*) or 101 (FIG. 8*a*) for generating the drive signals.

Figure 4A:
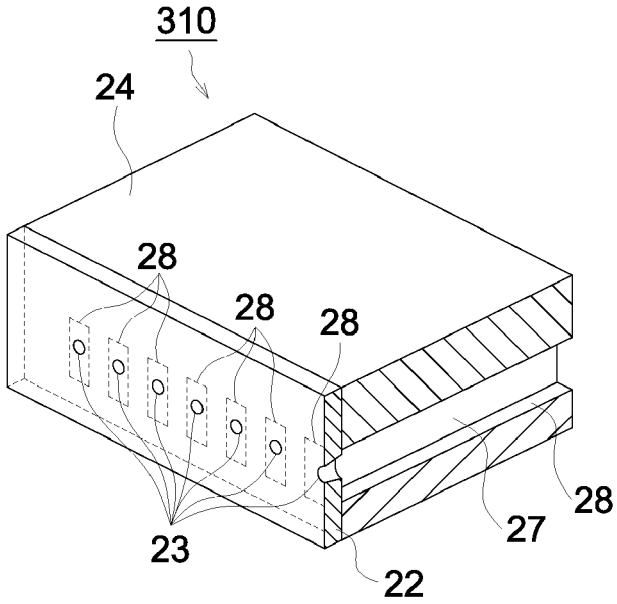
FIG. 4*a* is a partially sectional perspective diagram of an inkjet head chip for three-cycle drive system.
Figure 4B:
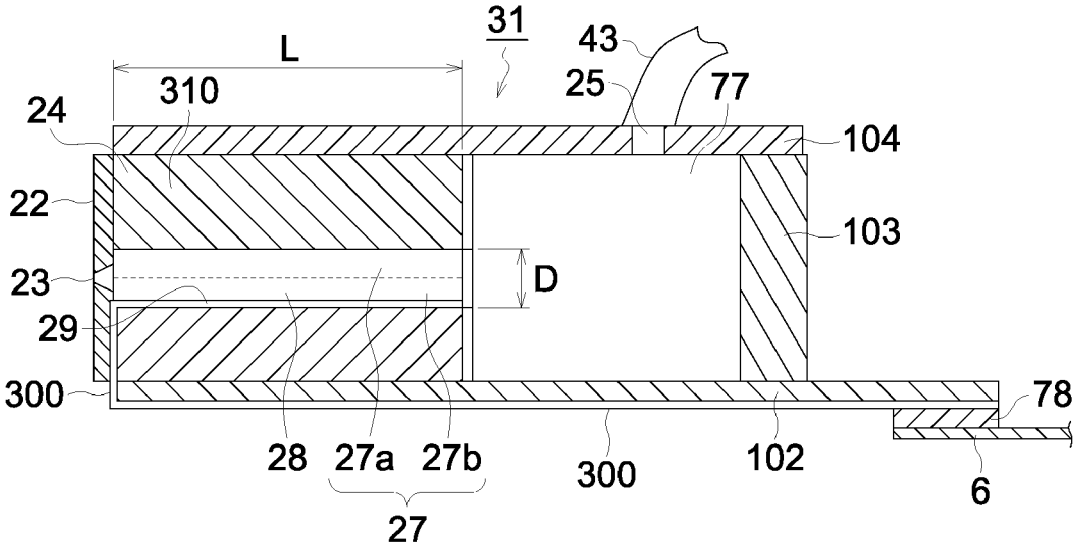
FIG. 4*b* is a sectional view of the ink channel viewed from the direction of channel arrangement for three-cycle drive system.

FIG. 4*a* is a partially sectional perspective diagram of a head chip portion of shear mode type inkjet head 31 for three-cycle drive system, and FIG. 4*b* is a sectional view of the ink channel 28 viewed from the direction of channel arrangement of shear mode type inkjet head 31 for three-cycle drive system.

Figure 7A:
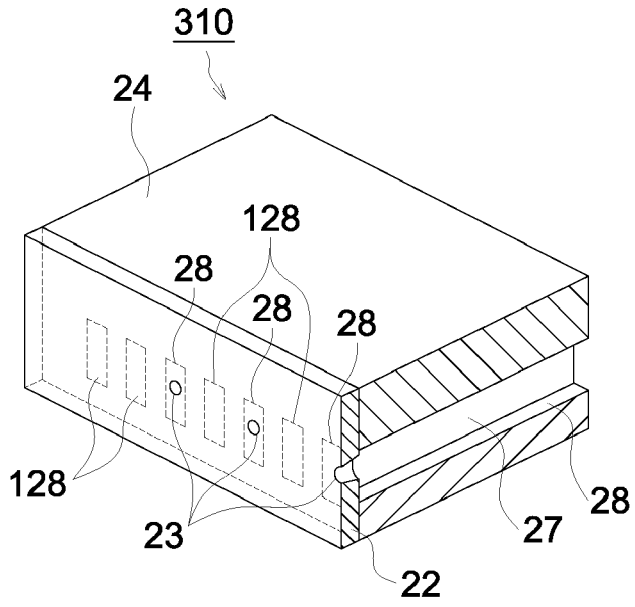
FIG. 7*a* is a partially sectional perspective diagram of an inkjet head chip in independent drive system.
Figure 7B:
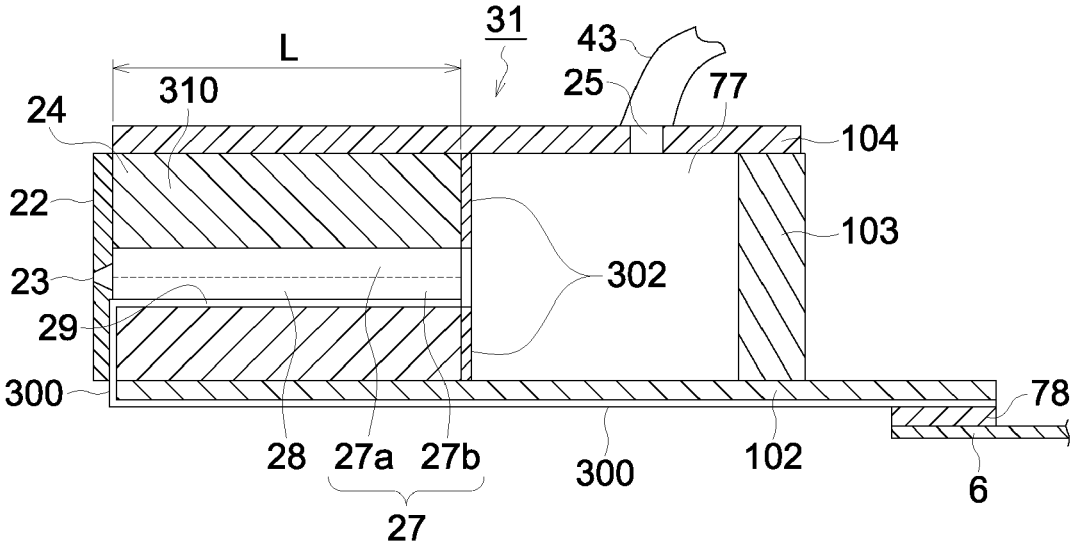
FIG. 7*b* is a sectional view of the ink channel viewed from the direction of channel arrangement for independent drive system.

FIG. 7*a* is a partially sectional perspective diagram of a head chip portion of shear mode type inkjet head 31 for independent drive system, and FIG. 7*b* is a sectional view of the ink channel 28 viewed from the direction of channel arrangement of shear mode type inkjet head 31 for independent drive system.

In the figures, 310 represents the head chip, and 22 represents a nozzle forming member adhered on a front surface of head chip 310.

Figure 5A:
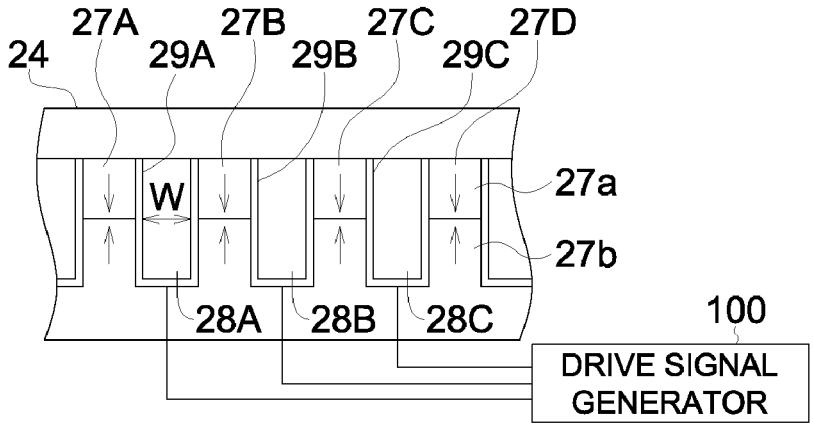
FIGS. 5*a*-5*c* are diagrams showing movements of the inkjet head at the time of ink ejection in three-cycle chive system.
Figure 5B:
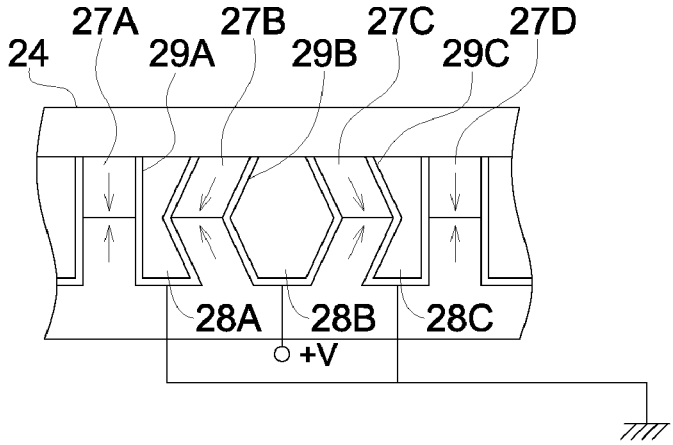
Figure 5C:
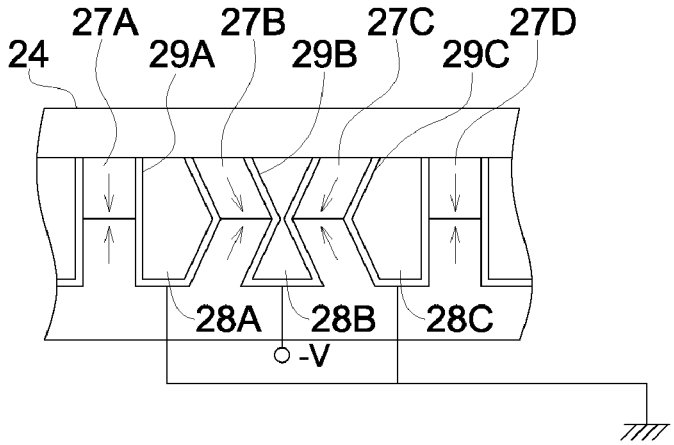

FIGS. 5*a*-5*c* are sectional diagrams of channel rows in shear mode type inkjet head for three-cycle drive system viewed from an elongated direction of channels in inkjet head.

Figure 8A:
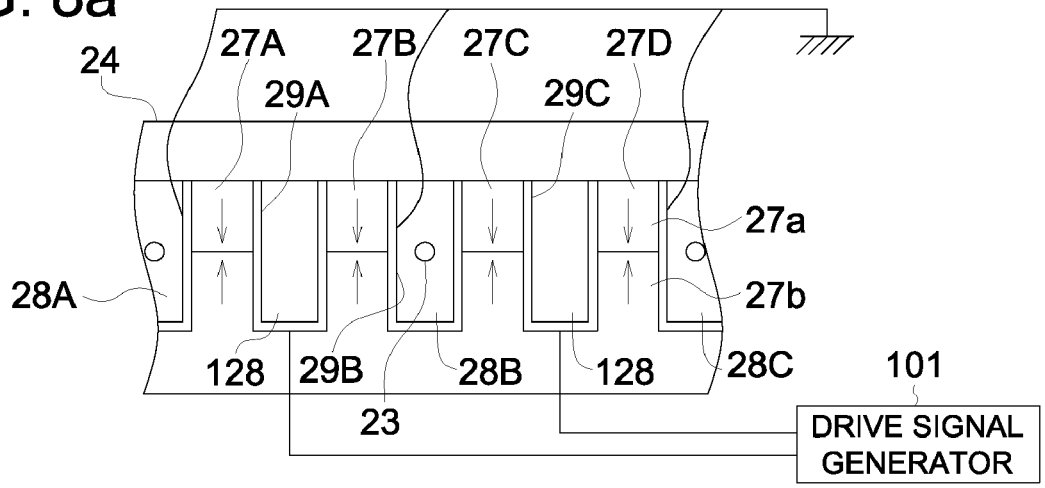
FIGS. 8*a*-8*c* are diagrams showing movements of the inkjet head at the time of ink ejection in independent drive system.
Figure 8B:
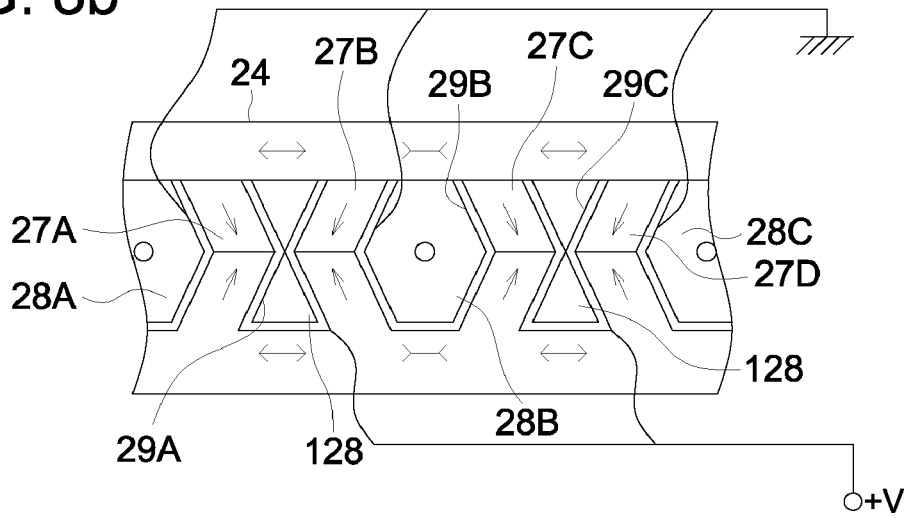
Figure 8C:
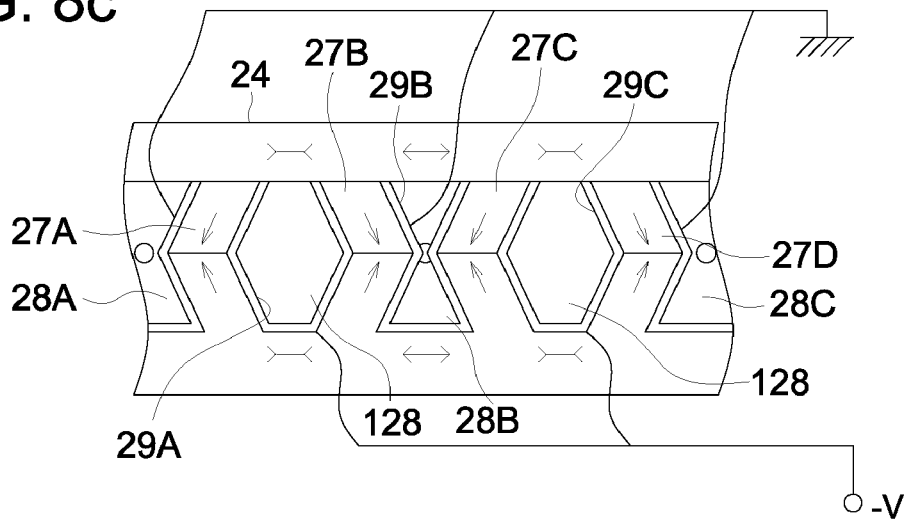

FIGS. 8*a*-8*c* are sectional diagrams of channel rows in shear mode type inkjet head for independent drive system viewed from an elongated direction of channels in inkjet head.

In the present specification, a face of the head chip from where the ink is ejected is designated as a "front face", and the opposite face as "back face". And top and bottom outer faces of the head chip sandwiching the channels arranged in parallel in the drawing are respectively designated as a "top face" and a "bottom face".

Head chip 310 is provided with channel rows where a plurality of channels 28 separated by separation wall 27 are arranged in parallel. Here, the channel rows have 512 pieces of channel 28, however the number of channels is not restricted.

Each separation wall 27 in this case is configured with two sheets of piezoelectric materials 27*a* and 27*b*, however, it is applicable to arrange the piezoelectric material for at least a part of partition wall 27.

There is no restriction to the piezoelectric material used in the piezoelectric materials 27*a* and 27*b*, provided that deformation occurs when voltage is applied. Publicly known materials can be used as the piezoelectric material. It can be a substrate made of an organic material. However, the substrate made of a piezoelectric non-metallic material is preferably utilized. For example, the substrates made of this piezoelectric non-metallic material include a ceramic substrate formed by molding and burning, and a substrate formed by coating and lamination. The organic material includes an organic polymer, and a hybrid material of the organic polymer and inorganic substance.

The ceramic substrate includes PZT ($PbZrO_3$—$PbTiO_3$) and third component added PZT. The third component contains $Pb(Mg_{1/3}Nb_{2/3})O_3$, $Pb(Mn_{1/3}Sb_{2/3})O_3$, $Pb(Co_{1/3}Nb_{2/3})O_3$. Further, $BaTiO_3$, ZnO, $LiNbO_3$ and $LiTaO_3$ can also be used to produce it.

In cases where two sheets of piezoelectric material is adhered such that each polarizing direction being opposite with each other as the present embodiment, the amount of shear displacement becomes doubled compared to the case of single sheet piezoelectric material, which causes an advantage that at most a half drive voltage is required to obtain the same amount of displacement.

In FIGS. 5*a*-*c*, three ink channels (28A, 28B, and 28C) which being a part of ink channels 28 are shown. These ink channels are separated by separation walls 27A, 27B, 27C and 27D.

In FIGS. 8*a*-*c*, three ink channels (28A, 28B, and 28C) which being a part of ink channels 28 are shown. These ink channels are separated by air channels 128.

At a front surface and a rear surface of head chip 310, a front side opening and a rear side opening of each ink channel 28 are respectively arranged to be opposed. Each ink channel 28 is configured as strait type where size and shape for the channel is almost unchanged in the longitudinal direction from the front side opening through the rear side opening.

One end of ink channel 28 (hereinafter, this may be called as nozzle end) is connected to nozzle 23 fowled on nozzle forming member 22, and the other end (hereinafter, may be called as manifold end) is connected to ink tube 43 via common ink room 47 and ink supply port 25.

As shown in FIGS. 4*a*-*b*, FIGS. 5*a*-*c*, FIGS. 7*a*-*b*, and FIGS. 8*a*-*c*, all inner surface of each channel 28 is adhered with electrode 29 formed of metal layer. Namely pieces of electrode 29 on the separation wall opposing each other in each channel are electrically connected. Electrode 29 in the ink channel is connected to drive signal generator 100 or 101 via connecting electrode 300 and anisotropic electro-conductive film 6.

Next, an example of manufacturing method of this kind of inkjet head 31 will be described below. However the present invention is not restricted to this.

Firstly, plate-shaped piezoelectric materials 27*a* and 27*b* configured with PZT polarized in thickness direction are laminated such that the directions of polarization become different with each other, and adhered with an epoxy-type adhesive agent. Further, on the surface of upper piezoelectric material plate 27*a*, a dry film is adhered.

Next, from the side of said dry film, plural parallel grooves are grounded by the use of dicing blade and the like, which become channels 28 and 128. Each of the grooves is formed from one end to the another end of piezoelectric materials 27*a* and 27*b*, and is ground with a certain depth D reaching to half of the under side piezoelectric material 27*b* (refer to FIG. 4*b*), to be a strait type groove in which sizes and shapes are almost unchanged in the longitudinal direction.

After that, from the groove formed side of the piezoelectric materials, spattering method, evaporation method or plating method is applied on metals for forming electrode such as Ni, Ai, Cu, Al and the like to form a metal layer on the upper surface of the dry film left without grinding and on the inner face of each grooves.

After that, the dry film as well as the metal layer formed on the surface of the dry film is removed, to obtain a board where the metal layer is fanned only on the inner face of the each groove.

Next, cover plate 24 is adhered to cover the each groove with an adhesive agent, and the board with the cover plate 24 is cut along the direction perpendicular to the longitudinal direction of the groove, thus, a plurality of head chips 310 each having channel rows are formed at one time. In the case of a head for time-division drive as shown in FIGS. 4*a* and 5*a*-*c*, which has no air channel, each groove becomes channel 28, and in the case of a head for independent drive as shown in FIGS. 7*a* and 8*a*-*c*, which has air channels, each groove becomes ink channel 28 or ink channel 128. The metal layer in each groove becomes electrode 29, and the part between the adjacent grooves configured with piezoelectric materials 27*a* and 27*b*, which are different in the polarized direction with each other by sandwiching the connection portion, becomes partition wall 27. Width between the cutting lines determines the drive length (shown by L in FIG. 4*b*) of channel 28 in head chip 310 produced by the cutting, and this width is properly determined according to the drive length.

After that, after fixing head chip 310 and wiring board 102, patterning is conducted on the front face of head chip 310 and front edge face and surface (the opposite face to the adhered face of head chip 310) of wiring board 102. After that, aluminum is evaporated, and the dry film is removed as well as the aluminum layer formed on the dry film, thus, each connection electrode 300 connected to electrode 29 in each channel is formed at a time.

The forming method of A1 layer is not restricted to evaporation, but any common thin layer forming method may be applied. Inkjet coating of electro-conductive paste may be applied. After forming the A1 layer, by removing the dry film with solvent peeling, the A1 layer formed on the dry film is removed, and only connection electrode 300 is remained on the front face of head chip 310 and on the front edge face and surface of wiring board 102.

In the head having air channels, on the rear face of head chip 310, a flow path restriction member 302 to prevent ink flow into air channel 128 is adhered so as to entirely close the opening of each air channel. In cases of the head not having the air channel, this kind of flow path restriction member is not provided.

After that, flow path board 104 is fixed. Then, enclosing wall 103 is fixed to enclose the rear face of head chip 310 extending from wiring board 102 through flow path board 104, and to form a common ink room 77. After that, flexible cable 6 is connected to each connecting electrode 300 of wiring board 102.

Next, a plate of nozzle forming member 22 formed with nozzle 23 is adhered via adhesive agent on head chip 310.

As a material of nozzle forming member 22, other than synthetic resins such as polyimide resin, polyethylene terephthalate resin, liquid crystal polymer, aromatic polyamide resin, polyethylene naphthalate resin, or polysulphone resin, a metal material such as stainless steel may be used.

The two chips, where electrodes and common ink room are formed as described above, are set position such that two nozzle rows are shifted by a half pitch with each other, and wiring boards of the two chips are adhered with an adhesive so as to face with each other. Thus a head having two nozzle rows arranged in zigzag and having twofold resolution can be produced.

Next, an ink ejection operation will be described.

As shown in the present embodiment, in cases where the inkjet head is configured with the piezoelectric material to be deformed with the shear mode, a rectangular wave (to be described later) can be more effectively utilized to lower the drive voltage and to enable an efficient drive operation.

Drive signal generator 100, or 101 includes a drive signal generation circuit (not illustrated) which generates a series of drive signals including at least one drive pulse for each one pixel period, and a drive pulse selection circuit (not illustrated) which selects and supplies to each pressure chamber a drive pulse out of the drive signals supplied from the drive signal generator in accordance with image data of each pixel. And the drive signal generator supplies a drive signal to drive partition wall 27 as a pressure generation section.

Upon receiving the image data, a controller (not illustrated) controls a mortar of conveyance rollers and allows the drive signal generator to generate a drive pulse which includes at least on pulse and off pulse. Further the controller outputs, to the drive pulse selection circuit, information of drive pulse to be selected based on the image data. Thus the drive pulse selection circuit selects a drive pulse based on the information and supplies to electrode 29 covering partition wall 27. By the above, an ink droplet can be ejected in one pixel period from nozzle 23 of recording head 31.

Next, the drive signal and the ejecting operation will be described.

When the drive signal from drive signal generator 100, 101 is applied onto electrode 29A, 29B, and 29C (electrode 29 for each channel), an ink droplet is ejected from nozzle 23 according to the operation exemplified below. In FIGS. 5*a*-5*c*, nozzles are omitted, and in FIGS. 8*a*-8*c*, indicated are nozzles formed only on ink channels.

In said recording head 31, positive or negative pressure is applied to the ink in ink channel 28 by the deformation of partition wall 27, thus partition wall 27 constitutes a pressure generation section.

First Embodiment

Next, a time division drive system which being an example of the drive method relating to the present embodiment is explained In the case of driving recording head 31, as shown in FIGS. 4*a*-*b* and 5*a*-*c*, containing multiple pressure chambers 28 which are partitioned by partition walls 27 each of which is at least partially made of piezoelectric materials, when one of ink channels 28 works to eject ink, the neighboring ink channels 28 are affected. To prevent this, the multiple ink channels 28 are usually grouped into two or more groups, each of the groups including pairs of ink channels sandwiching one or more ink channels of the other group. These pressure chamber groups are controlled in sequence to eject ink in a time-division manner. For example, three cycle ejecting method is conducted where all the ink channels 28 are grouped into three groups each containing every third channels to eject ink in three phase.

Figure 6A:
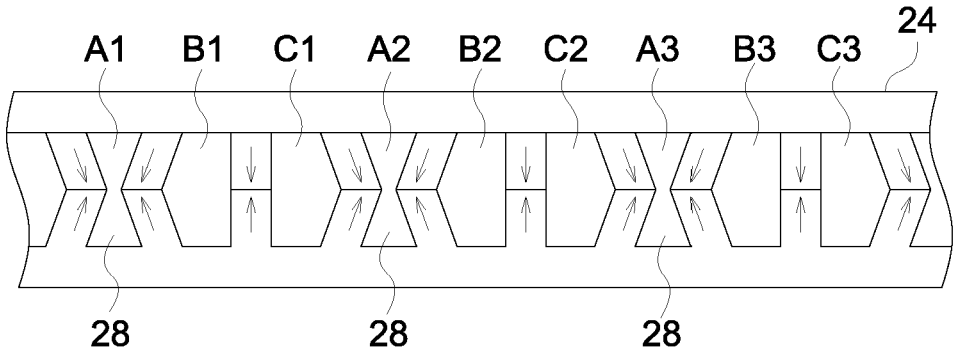
FIGS. 6*a*-6*c* are diagrams of time sharing movements of the inkjet head at the time of ink ejection in three-cycle drive system.
Figure 6B:
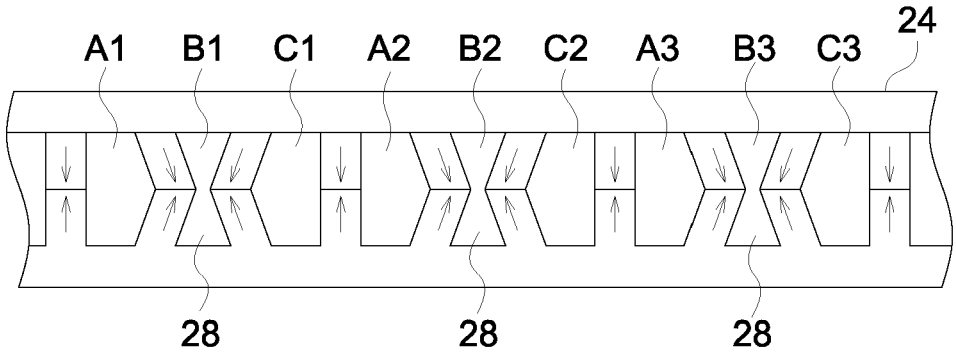
Figure 6C:
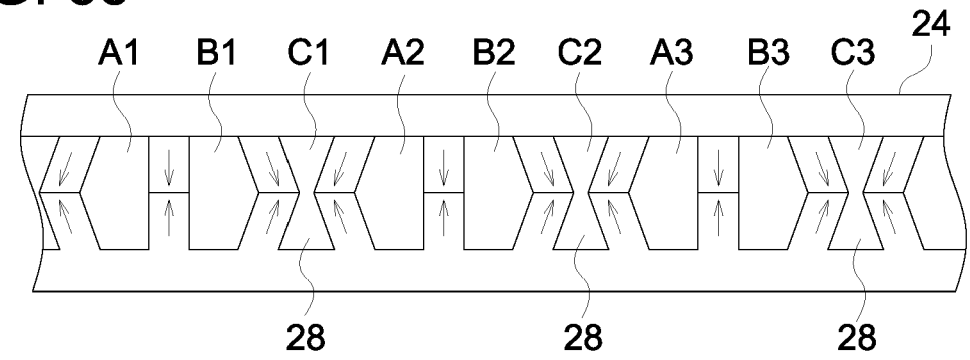

The 3-cycle ejection operation will be further explained referring to FIGS. 6*a*-6*c*. In the example shown in FIGS. 6*a*-6*c*, the recording head contains nine ink channels 28 (A1, B1, C1, A2, B2, C2, A3, B3, and C3).

At the time of ejection, voltages are applied to electrodes of respective ink channels 28 of group A (A1, A2, and A3), while the electrodes of the pressure chambers of neighboring groups B and C are grounded. By applying a drive signal including the first expansion pulse, contraction pulse, and the second expansion pulse to the electrode of ink channels 28 of group A, a minute droplet of ink is ejected from the nozzle connecting to the pressure chamber of A group.

After an elapse of certain time, each ink channel 28 of group B (B1, B2, and B3) and group C (C1, C2, and C3) are similarly operated in sequence.

Figure 10:
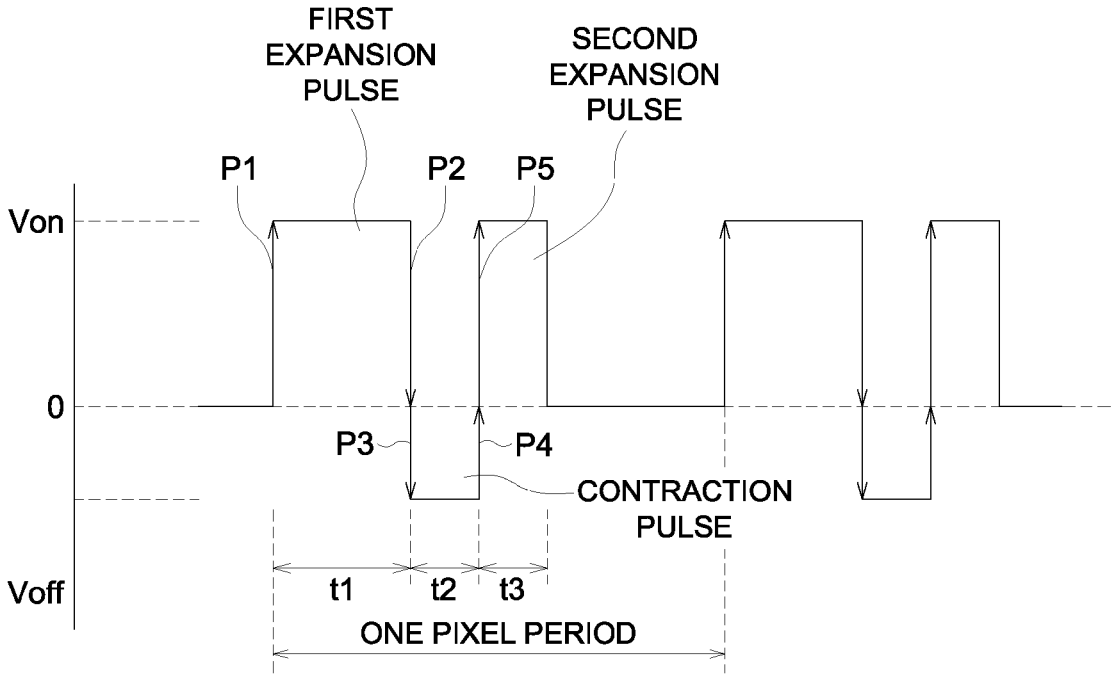
FIG. 10 shows a drive signal of the present invention to apply a single drive pulse in one pixel period to eject an ink droplet.

FIG. 10 shows a drive signal to realize the drive method of the embodiment relating to the present invention.

In FIG. 10, the horizontal axis represents AL time, and the vertical axis represents drive voltage.

Sign t1 represents the width of first expansion pulse.

Sign t2 represents the width of contraction pulse.

Sign t3 represents the width of second expansion pulse.

(1) In the state shown in FIG. 5*a* of recording head 31, when electrode 29A and 29C are grounded and electrode 29B is applied the first expansion pulse (positive voltage) of rectangular waveform, by rising of the first expansion pulse (P1), voltage of Von is applied to caused an electric field perpendicular to the direction of polarization of piezoelectric materials 27*a* and 27*b* which constitute partition walls 27B and 27C. This causes a shearing deformation in the jointed surface of partition walls of piezoelectric materials 27*a* and 27*b*. Consequently, as shown in FIG. 5*b* partition walls 27B and 27C both deform outward to expand the volume of ink channel 28B and thereby generate negative pressure to the ink in ink channel 28B to cause the ink to flow in (Draw).

Wherein, AL (Acoustic Length) is ½ of the acoustic resonance cycle period of the ink channel. AL can be obtained as a pulse width which maximizes the ejection velocity of ink droplets when the pulse width of rectangular pulses is varied with the rectangular pulse voltage kept constant in measurement of the ejection velocities of ink droplets which are ejected by applying rectangular pulses to partition wall 27 which is an electro-mechanical transducer. This value is determined depending on the head structure and the ink density.

Wherein pulse is a rectangular wave having a constant wave height voltage, and when 0V is assumed 0%, and the wave height voltage is assumed 100%, "pulse width" is defined as the interval respectively between the point of 10% voltage in the rise or fall from the voltage of 0V and the point of 10% voltage in the fall or rise from the pulse-height voltage.

Further, "rectangular wave" is assumed to be a waveform both of whose rise and fall time periods between 10% and 90% of the drive voltage are within 1/10 of AL and preferably within 1/20.

(2) Since the pressure wave in ink channel 28B repeats reversals at each 1 AL time period, when the voltage is returned to 0 volt (P2) after a lapse of 1 AL from the application of the first P1, partition walls 27B and 27C returns from the expansion position to a neutral position as shown in FIG. 5*a* to cause a high pressure on the ink in ink channel 28B. Here, the first expansion pulse width t1 is preferably 1 AL.

Successively, a contraction pulse (negative voltage Voff) of rectangular waveform is applied. Due to a falling edge of the contraction pulse (P3), partition walls 27B and 27C deform reversely with each other and the volume of channel 28B decreases. Due to this contraction, further high pressure is applied to the ink in ink channel 28B and an ink column is protruded from an opening of nozzle 23.

(3) After the elapse of t2 time period, when the voltage is returned to 0 and the second expansion pulse (Von) is successively applied (P5), the volume of channel 28B expands to cause a high negative pressure on the ink in ink channel 28B. Thus, a meniscus is drew-in and the rear edge of the protruded ink column is drew back to make the ink column diameter small and cut off an ink droplet.

After the elapse of t3 time period from P5, the voltage is returned to 0 to make the state of FIG. 5*a*, thus the pressure wave can be rapidly decreased.

The head is driven by repetition of the above described series of drive pulses. Therefore, the faster the rate of pressure wave decreases the faster the ink for next pixel can be ejected to enable the higher speed printing, which being preferable.

Width of the first expansion pulse largely affects to an ejection power of the ink droplet, and when this pulse width becomes 1 AL the ink ejection power (ejection speed) is maximized. Further the contraction pulse is applied at the falling edge of the first expansion pulse (P2), namely after the elapse of 1 AL. Thus, by setting the width of the first expansion pulse to 1 AL, at the same time when the negative pressure wave generated at rising edge of the expansion pulse (P1) transfers through the ink channel and reverses to positive pressure, the positive pressure, which is generated with the contraction of ink channel caused by falling edge (P2) of the expansion pulse and falling edge (P3) of the contraction pulse, is added, the most effective ejection power can be obtained with all of these effects. Therefore, advantage of high ejection speed of the ink can be attained.

Further, by setting the width of contraction pulse to be 0.1-0.5 AL, small droplets can be formed. In cases of less than 0.1 AL, since the time for the drive walls to respond is not sufficient, the droplet is volume cannot be decreased. In cases where the contraction pulse width exceeds 0.5 AL to become 0.6 AL, the droplet volume becomes rapidly large, which is not preferable.

Further, there are cases where the volume of the ink droplet is required to be adequately set according to conditions of resolution and gradation of the image. Further, the volume of the ink droplet is affected by a temperature of the recording head and the like. For example, in cases where the temperature of the recording head is low, a volume of the ejected ink droplet becomes small and a recorded dot area becomes small. On the contrary, in cases where the temperature of the recording head is high, a volume of the ejected ink droplet becomes large and a recorded dot area becomes large. Namely even in cases where recording is executed with the same image data and with the same drive pulse, if the temperature of the recording head is unstable, the size of dots formed on the recording medium, and consequently the image density will be unstable, and uneven density of the image will be caused.

Due to the above, it is preferable to control the volume of ink droplet by varying the contraction pulse width in the range of 0.1 AL through 0.5 AL.

The volume control of the ink droplet ejected from the recording head can be executed by the control section such as the CPU controlling drive signal generator 100 or 101, through modulation of the contraction pulse width in the drive pulse. Namely, as described below in case of requiring small ink droplet volume, the width of the contraction pulse is made small, and in case of requiring large ink droplet volume, the width of the contraction pulse is made large.

Thus, regardless the temperature of the recording head, for example, the volume of the ink droplet can be controlled in a prescribed control range. Further, according to the conditions of resolution and gradation of the image, the volume of ink droplet can be increased or decreased.

From the points of droplet volume and upper limit of stable ejection speed, the width of second expansion pulse is preferably 0.2 through 0.6 AL (not less than 0.2 AL and not more than 0.6 AL), and more preferably is 0.4 through 0.6 AL. In case of less than 0.2 AL, the droplet volume increases, and is not preferable for ejecting a small droplet. In case of exceeding 0.6 AL, the maximum stable ejection velocity of the droplet decreases rapidly, and is not preferable.

Further, the width of the contraction pulse is preferably smaller than the width of the second expansion pulse.

Further, a sum of widths of the contraction pulse and the second expansion pulse is preferably not less than 0.3 AL and not more than 0.9 AL.

Further, in the above embodiment the width of the first expansion pulse is set to be 1 AL, however it may be set to be not less than 0.7 AL and not more than 1.3 AL. Beyond this range, ejection efficiency by the pressure wave decreases, and the drive voltage needs to be largely increased.

Figure 9:
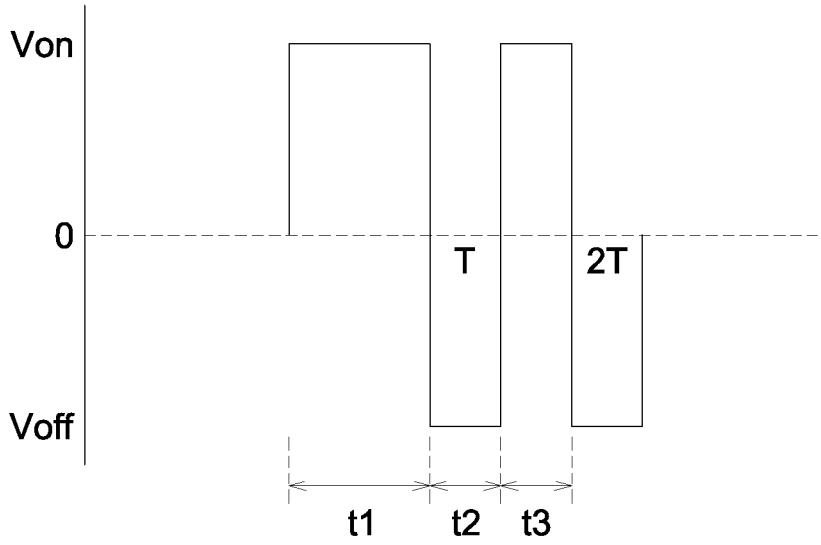
FIG. 9 shows a drive signal according to Patent Document 1.

FIG. 9 shows an example of the drive signal described in Patent Document 1. In this example, $|Von|/|Voff|=1$ is satisfied. Interval t1 between the first expansion pulse and the first contraction pulse is 1 AL, interval t2 between the first contraction pulse and the second expansion pulse is 0.5 AL, and pulse width t3 of the second expansion pulse is 0.5 AL. Wherein $|Von|$ represents the absolute value of Von, and $|Voff|$ represents the absolute value of Voff.

FIG. 10 shows the drive signal of the present invention. Here, $|Von|/|Voff|$ is in the range of 1.3 through 10, where a drive voltage of the first expansion pulse is Von and a drive voltage of the contraction pulse is Voff. Interval t1 is 1 AL, interval t2 is 0.1 through 0.3 AL (not less than 0.1 AL and not more than 0.3 AL), and pulse width t3 is 0.2 through 0.6 AL, thus one cycle period of the drive signal is made shorter than the drive signal of FIG. 9.

The ratio of $|Von|/|Voff|$ is required to be in the range of 1.3 through 10 from the points of droplet volume and length of satellite, is preferably 2 through 10, and is more preferably 3 through 10.

When droplets are ejected from the nozzle, the droplets fly in such a state that an ink column is extended in the rear direction from a main droplet. The ink column at the rear position becomes satellites (small droplets) before arriving to a recording medium. Wherein the longer the satellite length (distance from the main droplet to the rear most satellite), the more increased is volume of the satellites, which causes distortion of the image.

Further, the drive voltage of the second expansion pulse is set to be same as the drive voltage Von of the first expansion pulse. This is preferable in reducing the cost of drive signal generator 100 or 101 for generating the drive pulse by reducing the number of power supply voltages to reduce the circuit cost.

In the drive signal of the present embodiment, off-waveform corresponds to the contraction pulse and on-waveform corresponds to the first and the second expansion pulses. Further, GND (ground potential) is selectable in the waveform. Herein, since the drive voltage of the first expansion pulse is set to be same as the drive voltage of the second expansion pulse, each of the on-waveform and the off-waveform can be generated by merely digitally switching respective single power voltage of Von or Voff.

In the above embodiment, although an example of a drive signal which applies a single drive pulse in one pixel period to eject the ink droplet, the other drive signal may be utilized, which applies plural drive pulses each causing to eject respective ink droplet in one pixel period.

Figure 11:
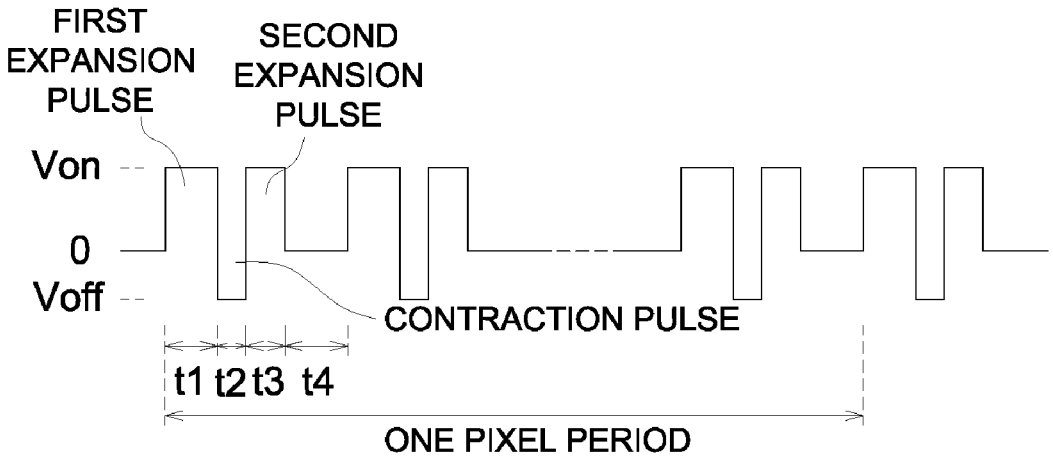
FIG. 11 shows a drive signal of the present invention to apply plural drive pulses in one pixel period respectively to eject each ink droplet.

FIG. 11 shows the drive signal which applies plural drive pulses each causing to eject respective ink droplet in one pixel period. As for each drive pulse in one pixel period, the drive pulse similar to that shown in FIG. 10 is used. The plural drive pulses are sequentially applied in a condition that a drive pulse halt period (ground potential period) is arranged between each of the plural pulses.

According to the present embodiment, in cases where N pieces of droplets ejected by N pieces of drive pulses (N is an integer larger than 2) are united during a fright before landing or united after landing on the recording medium to form a single super drop UD and to form a dot of one pixel, smaller sub-drops than prior art can be stably ejected with high drive frequency.

By the drive signal shown in FIG. 11, N pieces of ink droplets are ejected in maximum, and printing of gradations from 0-level to N-level can be performed.

For example, in the case of N=3, each of zero drop (0-level gradation), one drop formed with sub-drop $SD_1$ ejected by the first drive pulse in one pixel period (1-level gradation), two drops of $SD_1$ and $SD_2$ ejected by the second drive pulse in the one pixel period (2-level gradation), and three drops of $SD_1$, $SD_2$ and $SD_3$ ejected by the third (last) drive pulse in the one pixel period (3-level gradation) can be formed to realize the printing from 0-level gradation to 3-level gradation.

One example will be shown that when pulse width t1 of the first expansion pulse is 1 AL, pulse width t2 of the contraction pulse is 0.2 AL, and pulse width t3 of the second expansion pulse is 0.45 AL, the halt period of drive pulse t4 is 3.28 AL. The halt period of drive pulse t4 is preferably 0.7 AL through 5.2 AL.

Figure 12:
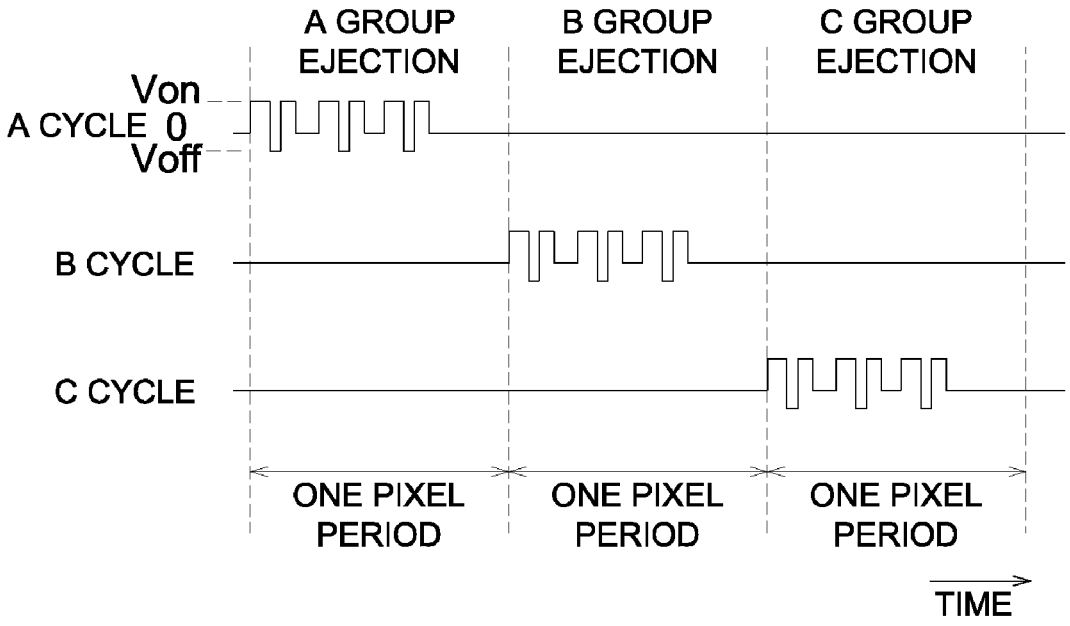
FIG. 12 is a time chart for drive signals applied to an electrode of each pressure chamber in each group of A, B, and C.

Next, three cycle ejection operation will be further described referring to FIG. 12. Based on the drive signal of FIG. 11, an example where N pieces of ink droplets (sub-drop) are ejected in one pixel period will be described. A timing chart of the drive signals to be applied on the electrode of pressure chamber of each group of A, B, and C is shown is FIG. 12.

A period to form a super drop by N pieces of sub-drops $SD_1$-$SD_N$ is assumed to be one pixel period.

At the time of ejecting ink, firstly a series of drive pulse voltages is applied to the electrode of each pressure chamber 28 in A group (A1, A2, and A3) for ejecting said $SD_1$-$SD_N$, with grounding the electrodes of adjoining pressure chambers of both sides, and ink droplets $SD_1$-$SD_N$ are ejected.

Subsequently, each pressure chambers in B group (B1, B2, and B3) are operated, and further subsequently each pressure chambers in C group (C1, C2, and C3) are operated similarly to the above.

Although the above described is the case for a solid image (full drive case), in actual the number of droplets to be ejected among $SD_1$-$SD_N$ is varied according to the print data of each pixel.

Further, a case is also possible where the plural drive pulses include a plurality of drive pulses, each having plural types of different contraction pulse width, and ink droplets of different volumes are ejected by each drive pulse, and then the ejected plural ink droplets are united before or after landing onto the recording medium to form a single pixel. According to this case, gradation can be improved.

Second Embodiment

Next, an independent drive head, which is an example of drive method relating to an embodiment of the present invention, will be described.

In the case of driving recording head 31, as shown in FIGS. 4*a-b* and FIGS. 5*a-c*, containing multiple ink channels 28 which are partitioned by partition walls 27 each of which is at least partially made of piezoelectric materials, to prevent the influence on neighboring ink channel 28 at the time of operating the partition wall of one of ink channels 28 to eject ink, a channel row is formed where ink channel 28 and air channel 128 are alternately arranged. Since the air channel 128 exist between each ink channel 28, an ink channel 28 is not influenced by the operation of partition wall of the neighboring ink channel 28. Thus, as shown in FIG. 7*a*, in an independent chive head, pressure chamber having an ink inlet and a nozzle is arranged at every two channels in the channel row.

Therefore, since in said independent drive head each pressure chamber can be driven by concurrently applying the drive signals shown in FIG. 10 or FIG. 11, the pressure chambers are not divided into A group, B group or C group. Regarding the other conditions, the drive in the second embodiment can be similarly executed to the first embodiment.

EXAMPLE

Example 1

Two set of shear mode type three-cycle drive head as shown in FIGS. 4*a-b*, and FIGS. 5*a-c*(nozzle pitch: 180 dpi, number of nozzles: 512, nozzle diameter: 27 μm, AL: 5.3 μs) are prepared, and adhered such that each nozzle row is shifted by ½ pitch with each other to form a zigzag arrangement. Since each is a head of 180 dpi, by shifting the each nozzle row by ½ pitch, the adhered head can be used as a recording head with 360 dpi which being a high recording density head having increased number of nozzles.

With supplying the ink to this head having two rows (nozzle pitch: 360 dpi, number of nozzles: 1024), the drive signal described below is applied to each channel of the head. Channels in the channel row are divided to three groups, and the three-cycle drive is executed with the conditions described below.

Ink: Mixed organic solvent type {(viscosity: 10 mPa·s, surface tension: 30 mN/m (measured at 25° C.));

<Drive Signal and Droplet Volume>

Figure 13:
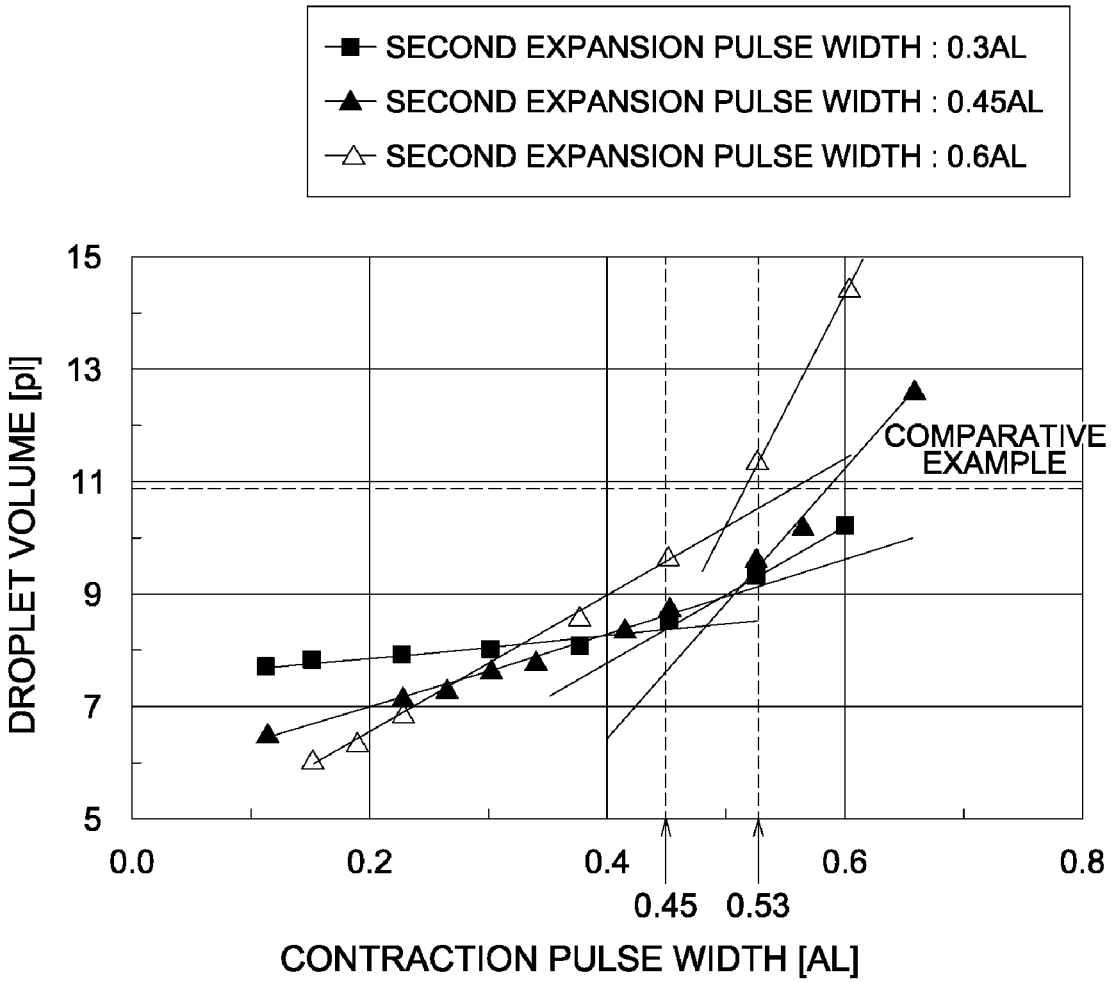
FIG. 13 shows relationships between a droplet volume and contraction pulse width.

Drive frequency: 12.6 kHz;

Drive voltage ratio of expansion pulse and contraction pulse: |Von|/|Voff|=2;

t1 (first expansion pulse width)=1 AL;

t2 (contraction pulse width): varied as shown in FIG. 13 (varied in the range of 0.1 AL through 0.65 AL);

t3 (second expansion pulse width): varied as shown in FIG. 13 (0.3 AL, 0.45 AL, or 0.6 AL); and Drive voltage Von was 12.5-17.5V (ejection experiment is conducted by varying the drive voltage in the range of 12.5 through 17.5V to measure droplet velocities and droplet volumes).

The droplet volume is shown in FIG. 13.

The droplet volume is relatively small in the condition of contraction pulse width 0.1-0.5 AL.

In contrast, the droplet volume of a comparative example where the same head and ink as described above are used and the head is driven with the same drive frequency and with a similar drive signal as described in the Patent Document 1: (|Von|/|Voff|=1, t1=1 AL, t2=0.5 AL, t3=0.5 AL) was 10.9 pl, which is indicated by a dashed line in FIG. 13.

Figure 15:
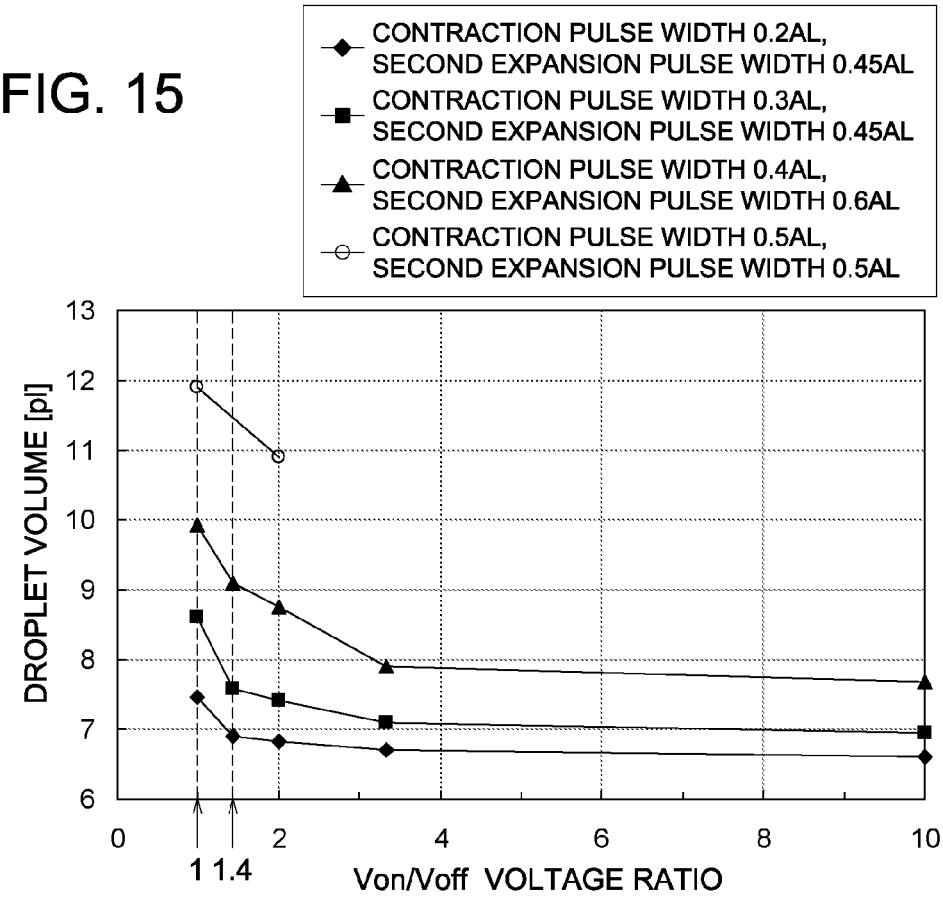
FIG. 15 shows relationships between a droplet volume and drive voltage ratio.

The droplet volume in the case of varying the ratio of |Von|/|Voff| is shown in FIG. 15. In FIG. 15, in cases where |Von|/|Voff| is 1.3 or more, the droplet volume becomes significantly small.

<Length of Satellite>

In the conditions where the contraction pulse width t2=0.3 AL, and the second expansion pulse width t3=0.45, the satellite length was evaluated by varying |Von|/|Voff|, and the evaluation result is shown in Table 1.

TABLE 1

| Test No. | \|Von\|/\|Voff\| | Length of satellite | Remark |
|---|---|---|---|
| 1 | 1.3 | A | Present invention |
| 2 | 3 | A | Present invention |
| 3 | 5 | A | Present invention |
| 4 | 10 | A | Present invention |
| 5 | 20 | B | Comparative example |
| 6 | 50 | C | Comparative example |

In Table 1, A, B, and C respectively represents the evaluation result as below,

A: Main droplet and satellites landed on the recording medium at the same position, and no distortion is observed in dot shape. Roughness in the image is not observed at all.

B: Main droplet and satellite landed somewhat separately on the recording medium, and dot shape is slightly distorted. Roughness in the image is somewhat observed.

C: Main droplet and satellite landed separately on the recording medium, pixel is disturbed and the dot shape is distorted. Remarkable roughness in the image is observed.

As shown in Table 1, the dot shape of the image is not distorted and roughness of the image is not observed in cases where |Von|/|Voff| is in the range of 1.3 through 10.

<Drive Signal and Pressure Wave>

Figure 14:
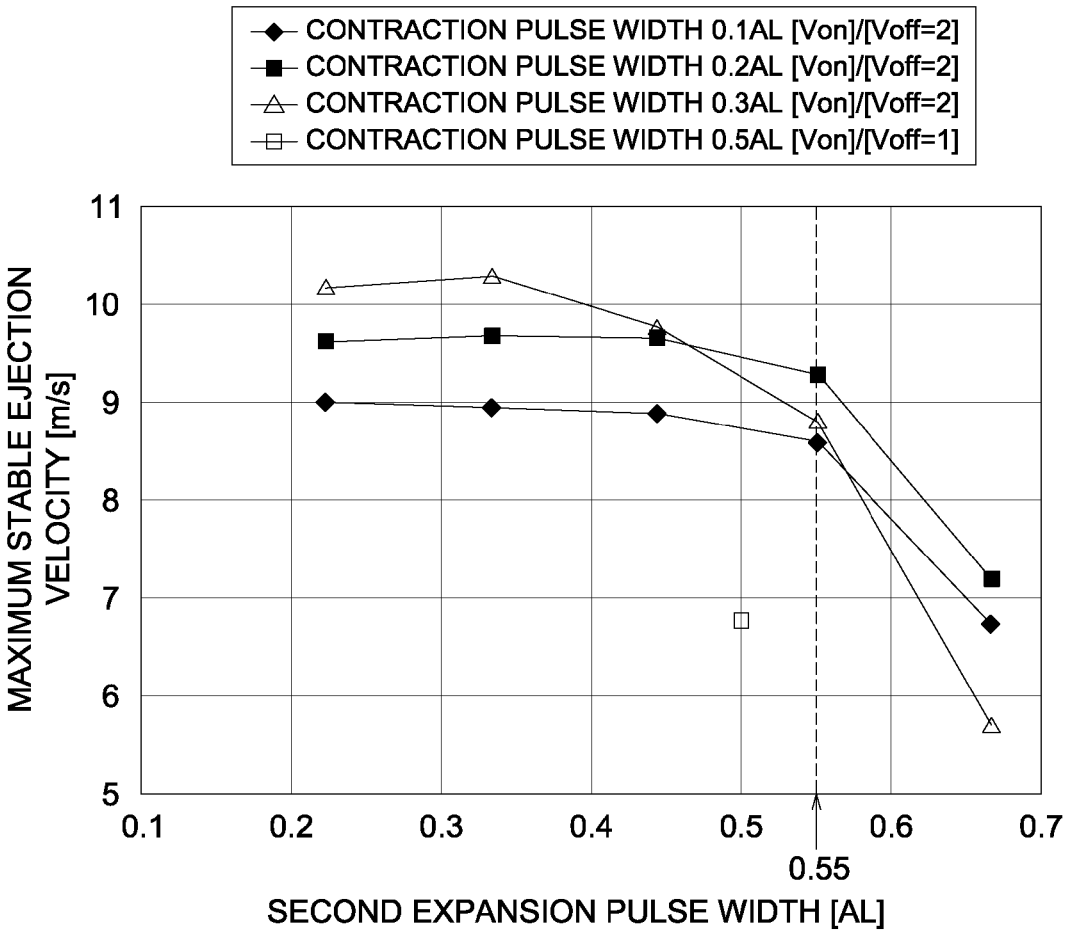
FIG. 14 shows relationships between maximum stable ejection velocity and second contraction pulse width.
Figure 16:
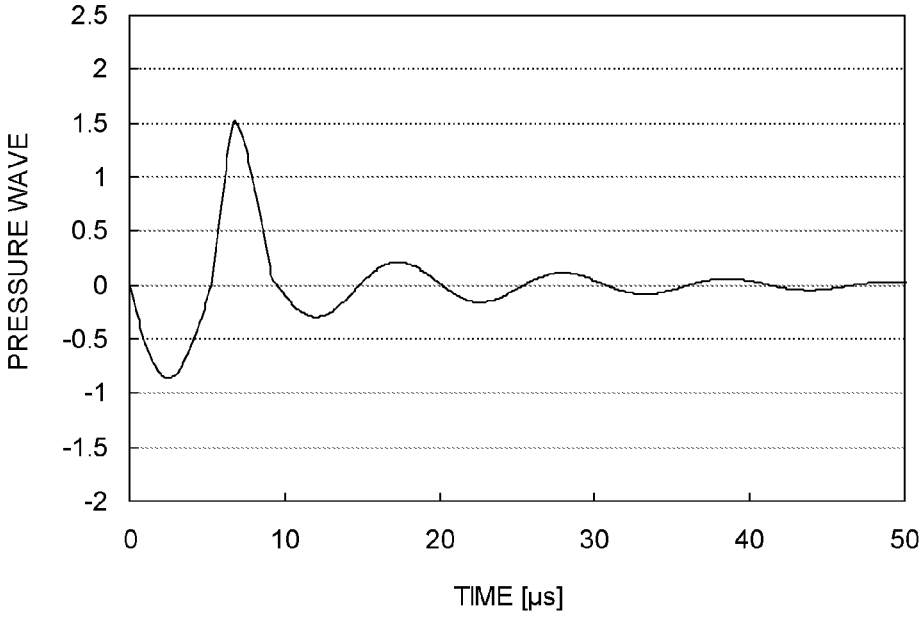
FIG. 16 shows a pressure wave of the present invention.
Figure 17:
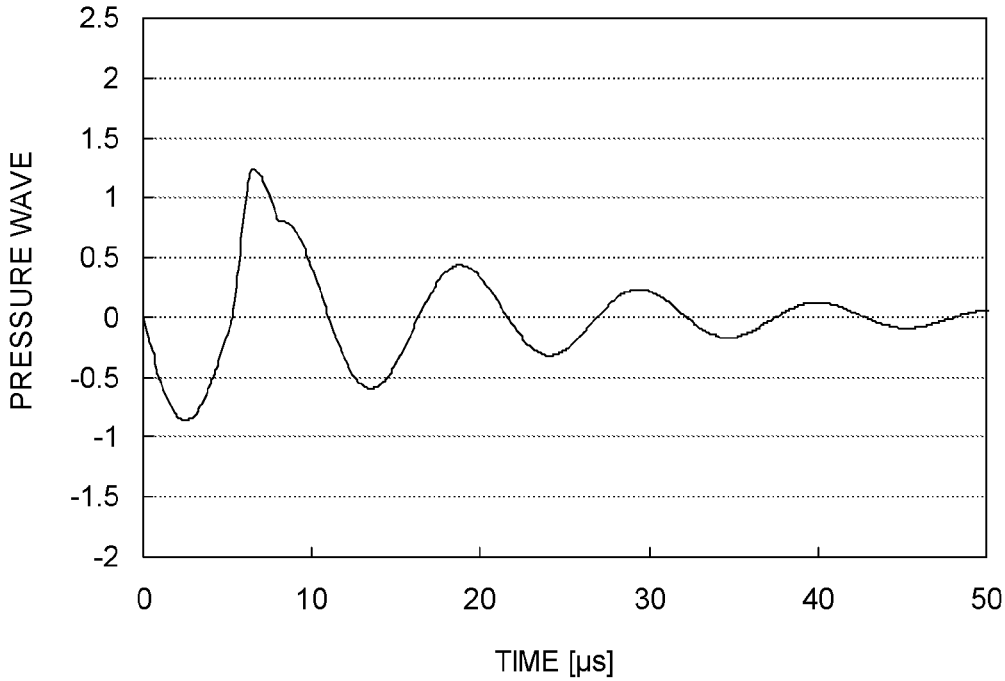
FIG. 17 shows a pressure wave of the comparative example.
Figure 18:
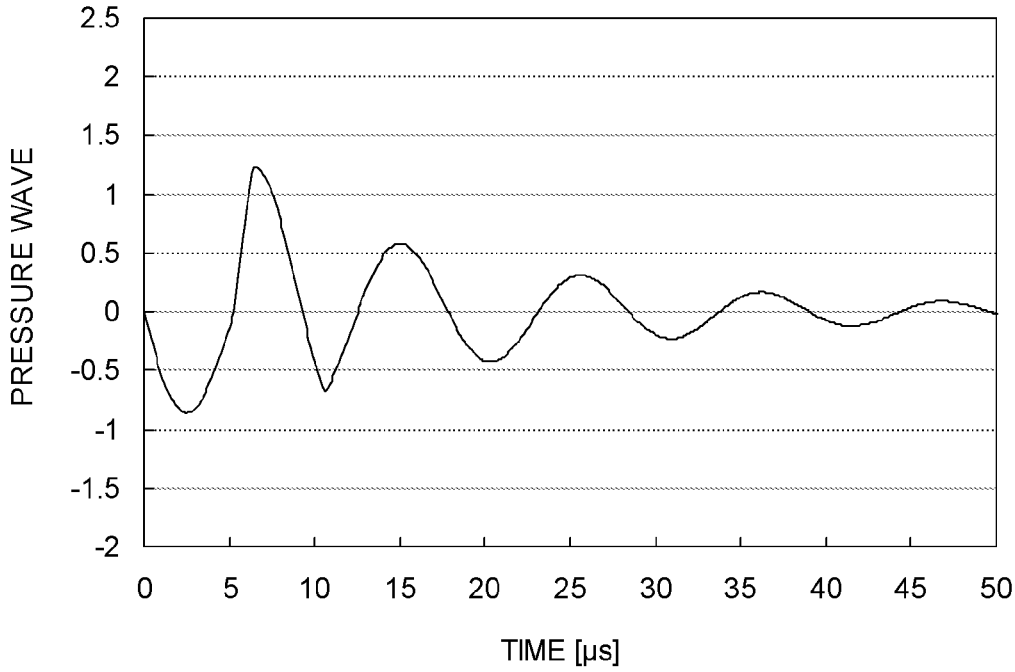
FIG. 18 shows a pressure wave of the comparative example.

In the state of |Von|/|Voff|=2, by the same conditions as the above, except that the contraction pulse width and the second expansion pulse width are varied as described below, simulation of decaying state of the pressure wave after the head having been driven is executed. The result is shown in FIGS. 16-18. In FIGS. 14-16, the vertical axis represents a relative value of the pressure.

FIG. 16 (Present Invention), contraction pulse width: 0.2 AL, second expansion pulse width: 0.5 AL, FIG. 17 (Present Invention), contraction pulse width: 0.2 AL, second expansion pulse width: 0.1 AL, FIG. 18 (Present Invention), contraction pulse width: 0.2 AL, second expansion pulse width: 0.8 AL, From these figures, it is understood that FIG. 16, which satisfies the condition of the second expansion pulse width being 0.2 AL through 0.6 AL, represents faster decay of the pressure wave than FIG. 17 or 18 which do not satisfy the above condition.

<Maximum Stable Ejection Velocity>

In each drive signal applying conditions, while increasing the flying velocity of ink droplet by raising the drive voltage, the flying conditions are observed. Upper limit of flying velocity, that does not cause unstableness in ejection due to air being took in the pressure chamber, is defined as maximum stable ejection velocity.

In the state of |Von|/|Voff|=2, by the same conditions as the above, except that the contraction pulse width is varied in the range of 0.1 AL through 0.3 AL, and the second expansion pulse is varied in the range of 0.2 AL through 0.7 AL, ejection experiments are executed and the maximum stable ejection velocity (upper limit of stable flying velocity of the droplet) is illustrated in FIG. 14. From FIG. 14, it is understood that in conditions where the second expansion pulse width is in the range of 0.2 AL through 0.6 AL, the maximum stable ejection velocity is kept high compared to the case of 0.7 AL; in conditions where the second expansion pulse width is in the range of 0.2 AL through 0.5 AL, the maximum stable ejection velocity is kept further in high level, and in conditions where the second expansion pulse width is in the range of 0.2 AL through 0.4 AL, the maximum stable ejection velocity is kept in highest level.

In contrast, by the same conditions as the above, except that |Von|/|Voff|=1, contraction pulse width=0.5 AL, and second expansion pulse width=0.5 AL (these conditions correspond to the drive signal described in Patent Document 1) the maximum stable ejection velocity is measured and illustrated in FIG. 14, which is lower than the maximum stable ejection velocity of the present invention. This shows effectiveness of the present invention.

Figure 19:
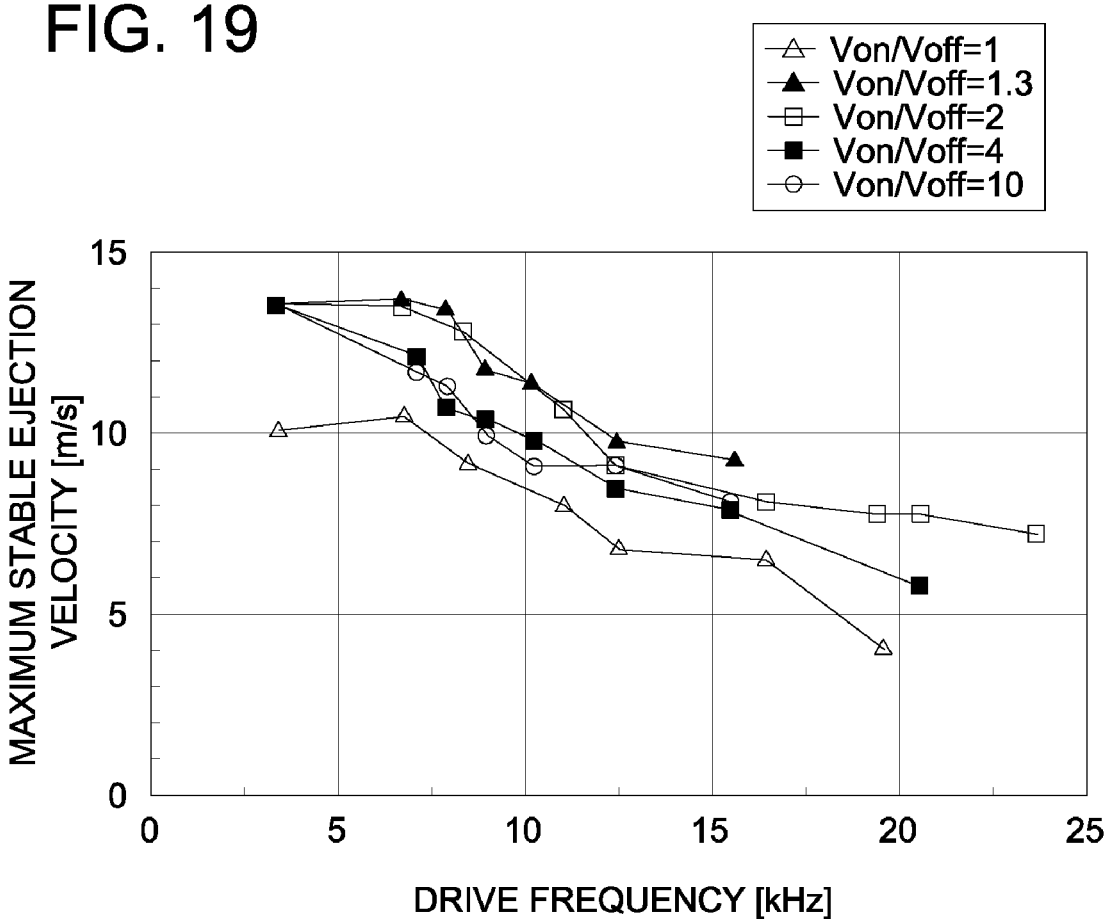
FIG. 19 shows maximum stable velocity of droplet ejection.

Relationships between drive frequency and maximum stable ejection velocity are illustrated in FIG. 19 in cases where ejections are executed in the drive conditions of the present invention(|Von|/|Voff| is 1.3 through 10, first expansion pulse width=1 AL, contraction pulse width=0.27 AL, and second expansion pulse width=0.45 AL), and in conditions of the drive signal of Patent Document 1 (|Von|/|Voff|=1, first expansion pulse width=1 AL, contraction pulse width=0.5 AL, and second expansion pulse width=0.5 AL). From FIG. 19 it is understood that according to the present invention, the maximum stable ejection velocity is maintained high through the wide range of drive frequency. In general, in cases of increasing the ink ejection velocity, the ejection becomes unstable due to that the air being took in the pressure chamber and the like. The maximum stable ejection velocity is referred as the upper limit of velocity with which the ink droplet is stably ejected. From the above, it will be understood that by utilizing the drive method of the present invention, high frequency drive is enabled and improvement of printing speed will be realized.

Example 2

By utilizing a similar inkjet head as that of EXAMPLE 1 except for the conditions of nozzle diameter=20 μm and AL=3.0 μs, and applying the drive signal based on that shown in FIG. 10, the same ink as used in EXAMPLE 1 is ejected.

The drive signal:

t1=1 AL, t2=varied in the range of 0.1 through 0.6 AL, t3=0.45 AL,

|Von|/|Voff|=2,

Drive frequency=22.2 kHz.

Drive voltage was 18-21V.

Figure 20:
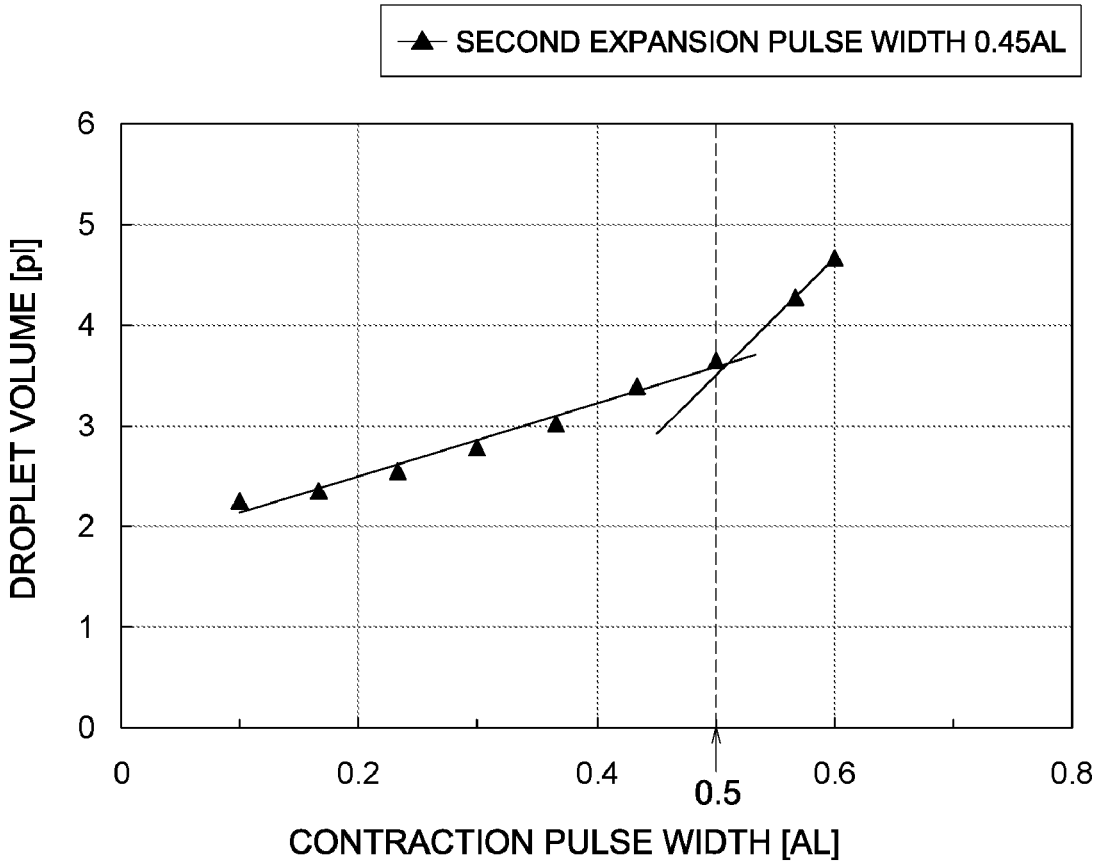
FIG. 20 shows relationships between a droplet volume and contraction pulse width.

Relationship between the contraction pulse width and the liquid droplet volume is illustrated in FIG. 20.

Shown in FIG. 20 is that in cases where the contraction pulse width is in the range of 0.1 through 0.5 AL, the droplet volume remains small, and in cases where the pulse width exceeds that range, the droplet volume rapidly increases.

Example 3

By utilizing a similar inkjet head as that of EXAMPLE 1 except for the conditions of nozzle diameter=30 μm, AL=4.5 μs, and the head being an independent driven shear mode type, and by applying the drive signal based on that shown in FIG. 10, the ink described below is ejected.

The drive signal:

t1=1 AL, t2=varied in the range of 0.1 through 0.8 AL, t3=0.45 AL,

|Von|/|Voff|=2,

Drive frequency=20 kHz.

Ink:

Mixed liquid of water and organic solvent,

Viscosity=5.7 mPa·s

Surface tension: 41 mN/m,

Drive voltage was 11-22V.

Figure 21:
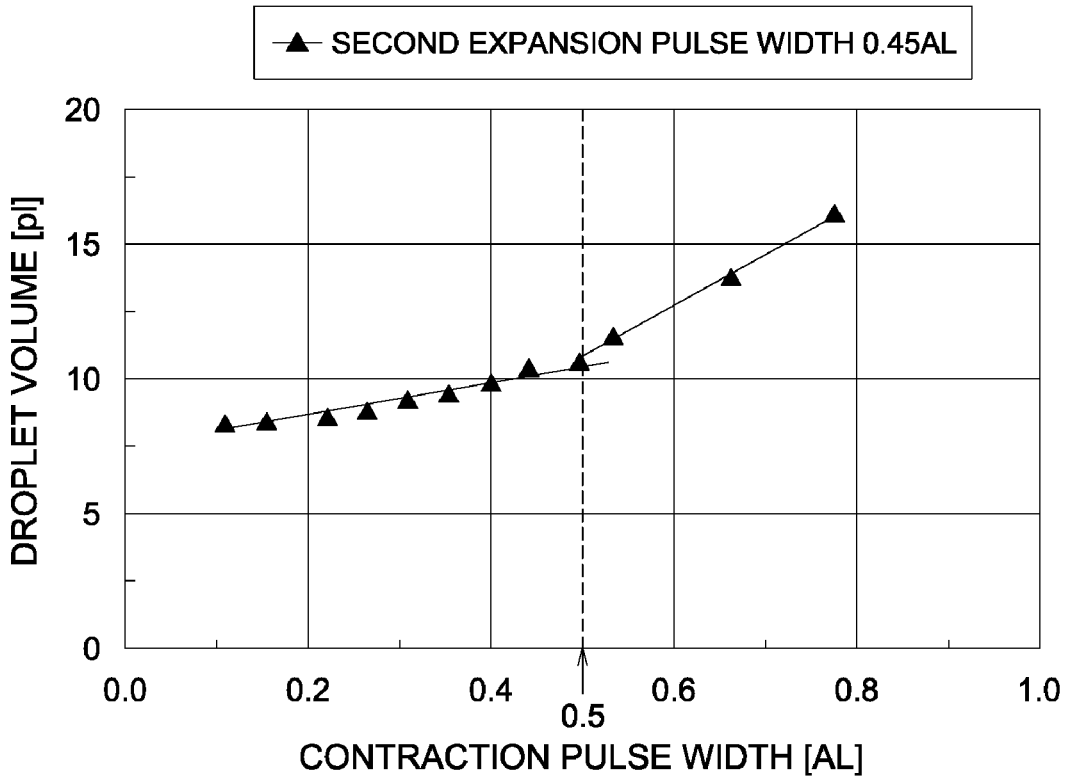
FIG. 21 shows relationships between a droplet volume and contraction pulse width.

Relationship between the contraction pulse width and the liquid droplet volume is illustrated in FIG. 21.

Shown in FIG. 21 is that in cases where the contraction pulse width is in the range of 0.1 through 0.5 AL, the droplet volume remains small, and in cases where the pulse width exceeds that range, the droplet volume rapidly increases.

Example 4

By utilizing a similar inkjet head as that of EXAMPLE 1 except for the conditions of nozzle diameter=20 μm, AL=3.6 μs, and by applying the drive signal based on that shown in FIG. 10, the ink described below is ejected.

The drive signal:

t1=1 AL, t2=0.27 AL, t3=0.45 AL,

|Von|/|Voff|=2,

Drive frequency=22.2 kHz.

Ink:

Ink composed of silver nanoparticles dispersed in organic solvent,

Viscosity: 8.9 mPa·s,

Surface tension: 26 mN/m,

Drive voltage was 16.4 V.

The liquid volume in the case of applying the above drive signal was 1.4 pl, in contrast to the liquid volume having been 2.2 pl in the case of applying drive signal of Patent Document 1. Since it is enabled to eject such a fine particles, the present invention is particularly effective in cases of utilizing on a circuit board that requires the drawing with fine lines.

What is claimed is:

1. An inkjet recording apparatus comprising:

a recording head having a nozzle to eject an ink droplet, a pressure chamber connected to the nozzle, and a pressure generation section to vary a volume of the pressure chamber; and a drive signal generator which generates a drive signal for applying at least one drive pulse within one pixel period to eject the ink droplet, wherein the inkjet recording apparatus is configured to eject the ink droplet from the nozzle by applying the drive signal to activate the pressure generation section, wherein the drive signal generator is configured to generate the drive signal within one pixel period in chronological order including a first expansion pulse to expand the volume of the pressure chamber, a contraction pulse to contract the volume of the pressure chamber, and a second expansion pulse to expand the volume of the pressure chamber again, and wherein a pulse width of the first expansion pulse is greater than 0.8 AL and less than 1.3 AL, a pulse width of the contraction pulse is not less than 0.1 AL and not more than 0.5 AL, where AL represents a half of an acoustic resonance period of the pressure chamber, and |Von|/|Voff| is not less than 1.3 and not more than 10, where Von represents a drive voltage of the first expansion pulse, and Voff represents a drive voltage of the contraction pulse.

2. The inkjet recording apparatus of claim 1, wherein a pulse width of the second expansion pulse is not less than 0.2 AL and not more than 0.6 AL.

3. The inkjet recording apparatus of claim 1, wherein a sum of a pulse width of the contraction pulse and a pulse width of the second expansion pulse is not less than 0.3 AL and not more than 0.9 AL.

4. The inkjet recording apparatus of claim 1, wherein a pulse width of the first expansion pulse is 1 AL.

5. The inkjet recording apparatus of claim 1, wherein a pulse width of the contraction pulse is less than a pulse width of the second expansion pulse.

6. The inkjet recording apparatus of claim 1, wherein the apparatus varies a pulse width of the contraction pulse within a range of 0.1 AL through 0.5 AL to control a volume of the ink droplet.

7. The inkjet recording apparatus described claim 1, wherein the drive signal generator is configured to generate the drive signal for applying a plurality of drive pulses within one pixel period, each of the plurality of drive pulses including the first expansion pulse, the contraction pulse and the second expansion pulse, in such a manner that a plurality of ink droplets each ejected by each of the plurality of drive pulses are united before or after landing on recording medium to form a single pixel.

8. The inkjet recording apparatus of claim 7, wherein the plurality of drive pulses include plural types of drive pulses respectively having contraction pulse widths different with each other within a range from 0.1 AL through 0.5 AL, and the respective plural types of drive pulses cause to eject plural types of ink droplets having different volumes with each other.

9. The inkjet recording apparatus of claim 1, wherein a drive voltage of the second expansion pulse is equal to a drive voltage Von of the first expansion pulse.

* * * * *